US008713776B2

(12) United States Patent
Herbold

(10) Patent No.: US 8,713,776 B2
(45) Date of Patent: May 6, 2014

(54) SYSTEM AND TOOL FOR INSTALLING COMBUSTION LINERS

(75) Inventor: John William Herbold, Fountain Inn, SC (US)

(73) Assignee: General Electric Company, Schenectady, NY (US)

( * ) Notice: Subject to any disclaimer, the term of this patent is extended or adjusted under 35 U.S.C. 154(b) by 1003 days.

(21) Appl. No.: 12/755,787

(22) Filed: Apr. 7, 2010

(65) Prior Publication Data

US 2011/0247193 A1 Oct. 13, 2011

(51) Int. Cl.
*B21D 39/04* (2006.01)

(52) U.S. Cl.
USPC ..... 29/282; 29/256; 29/267; 29/271; 29/278

(58) Field of Classification Search
USPC ..... 29/256–259, 266, 260, 426.5, 428, 464
See application file for complete search history.

(56) References Cited

U.S. PATENT DOCUMENTS

| | | | | |
|---|---|---|---|---|
| 4,004,333 | A * | 1/1977 | Daniels | 29/38 C |
| 4,908,925 | A * | 3/1990 | Johnson | 29/260 |
| 5,274,991 | A | 1/1994 | Fitts | |
| 5,323,600 | A * | 6/1994 | Munshi | 60/772 |
| 6,279,313 | B1 | 8/2001 | Lawen, Jr. et al. | |
| 6,345,441 | B1 | 2/2002 | Farmer et al. | |
| 6,886,584 | B2 * | 5/2005 | Turvey | 137/315.41 |
| 6,923,002 | B2 | 8/2005 | Crawley et al. | |
| 6,951,109 | B2 | 10/2005 | Lemon et al. | |
| 7,040,096 | B2 | 5/2006 | Manteiga et al. | |
| 7,086,232 | B2 | 8/2006 | Moertle et al. | |
| 7,093,440 | B2 | 8/2006 | Howell et al. | |
| 7,207,168 | B2 * | 4/2007 | Doepker et al. | 59/71 |
| 7,272,886 | B2 * | 9/2007 | Thomson | 29/724 |
| 7,360,364 | B2 | 4/2008 | Danis et al. | |
| 7,493,767 | B2 | 2/2009 | Bunker et al. | |
| 8,276,253 | B2 * | 10/2012 | Herbold et al. | 29/282 |
| 2011/0247193 | A1 * | 10/2011 | Herbold | 29/464 |

OTHER PUBLICATIONS

U.S. Appl. No. 12/477,451, filed Jun. 3, 2009.

* cited by examiner

*Primary Examiner* — Minh Trinh
(74) *Attorney, Agent, or Firm* — Dority & Manning, P.A.

(57) ABSTRACT

An installation tool and method are disclosed for installing a combustion liner within a combustor. The installation tool comprises a frame and a pusher block. The frame includes a substantially horizontal member and a plurality of side members. The pusher block is disposed between the side members and may be configured to push against the combustion liner.

20 Claims, 5 Drawing Sheets

FIG. —1—

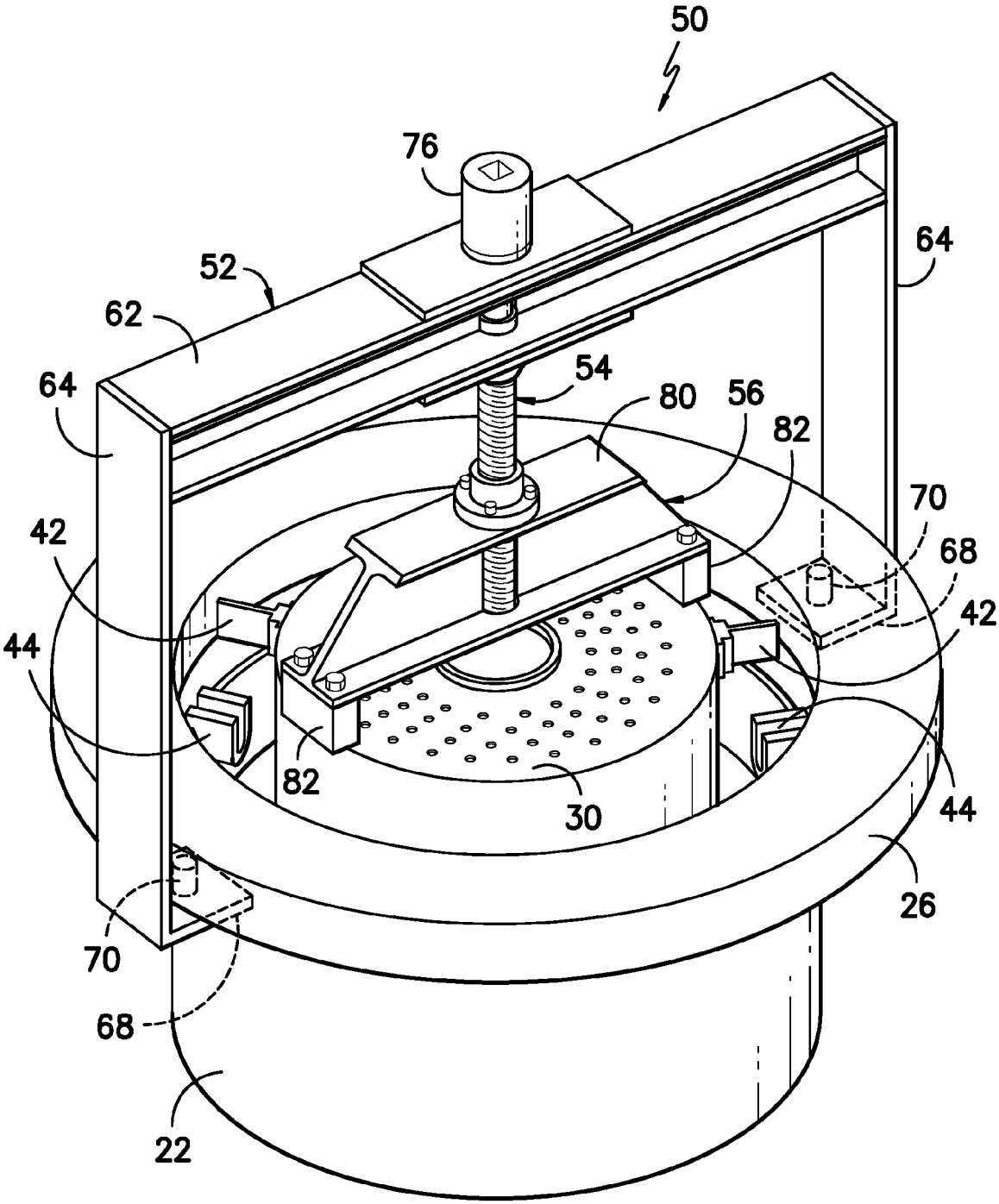
FIG. —4—

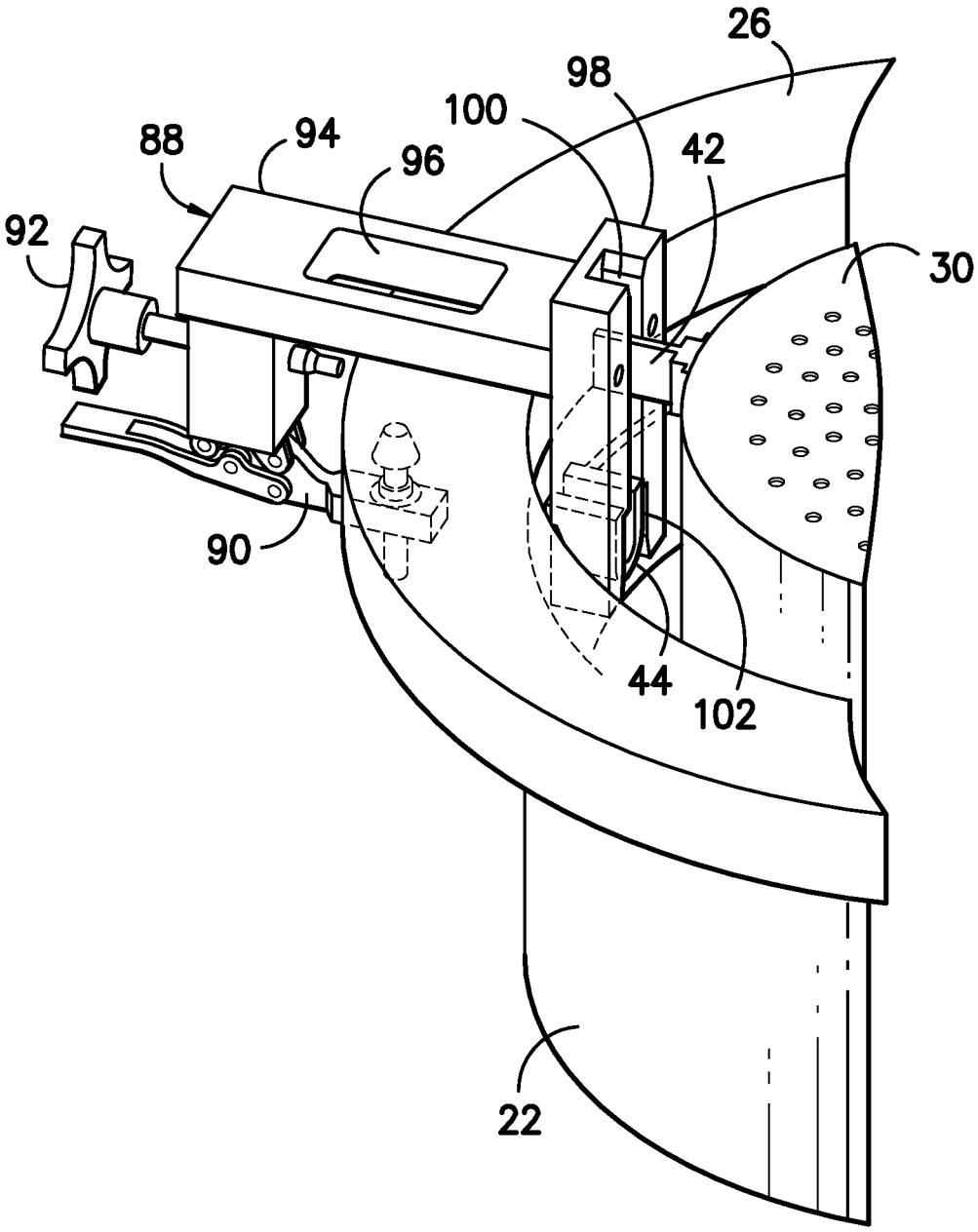
FIG. –5–

SYSTEM AND TOOL FOR INSTALLING COMBUSTION LINERS

FIELD OF THE INVENTION

The present subject matter relates generally to combustion liners of combustors and particularly to an apparatus and method for installing a combustion liner within a combustor.

BACKGROUND OF THE INVENTION

Gas turbines typically include a compressor section, a combustion section, and a turbine section. The compressor section pressurizes air flowing into the turbine. The pressurized air discharged from the compressor section flows into the combustion section, which is generally characterized by a plurality of combustors disposed around an annular array about the axis of the engine. Each of the plurality of combustors includes a combustion liner, which defines the combustion chamber of the combustor. As such, air entering each combustor is mixed with fuel and combusted within the combustion liner. Hot gases of combustion flow from the combustion liner through a transition piece to the turbine section of the gas turbine to drive the turbine and generate power.

Combustion liners are routinely removed during combustor maintenance activities. However, to re-install a combustion liner within a combustor, a significant amount of force is often required to overcome the friction at the interface between the combustion liner and the transition piece. For example, a hula seal is typically disposed at this interface that must be compressed in order to permit the combustion liner to slide into the transition piece. This often requires several hundred pounds of axial installation force. In the past, such installation force has been applied with a manually operated hammer. However, manually hammering the combustion liner into place can damage combustor components and can result in injury to the maintenance workers. Moreover, the hammering force applied to the combustion liner often varies significantly, which may result in the combustion liner being improperly aligned in the combustion casing and/or not fully seated against the combustion liner stops.

Accordingly, an installation tool which allows for the safe and relatively simple installation of a combustion liner within a combustor would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to an installation tool for installing a combustion liner within a combustor. The installation tool comprises a frame and a pusher block. The frame includes a substantially horizontal member and a plurality of side members. The pusher block is disposed between the side members. Additionally, the installation tool includes a means for pushing the pusher block against the combustion liner.

In another aspect, the present subject matter is directed to a method of installing a combustion liner within a combustor. The method includes partially inserting the combustion liner within the combustor, securing a frame to the combustor, and pushing a pusher block against the combustion liner. The frame includes a substantially horizontal member and a plurality of side members, wherein the pusher block is disposed between the side members.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWING

A full and enabling disclosure of the present invention, including the best mode thereof, directed to one of ordinary skill in the art, is set forth in the specification, which makes reference to the appended figures, in which:

FIG. 4 illustrates a perspective view of an embodiment of a installation tool for installing a combustion liner within a combustor in accordance with an aspect of the present subject matter, particularly illustrating the installation tool connected to a portion of the combustor; and FIG. 5 illustrates a perspective view of an embodiment of an alignment guide that may be used with the installation tool of the present subject when installing a combustion liner within a combustor.

DETAILED DESCRIPTION OF THE INVENTION

Figure 1:
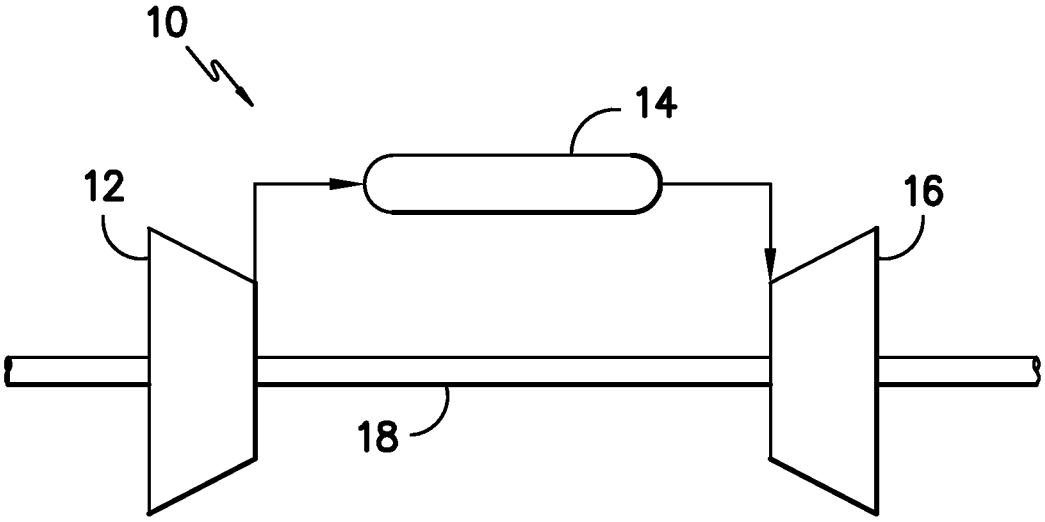
FIG. 1 illustrates a schematic depiction of an embodiment of a turbine assembly.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present subject matter is directed to an installation tool for installing combustion liners within a combustor of a turbine. Installation is accomplished by securing or attaching the installation tool to the combustor and pushing a pusher block against the combustion liner to force the liner within the combustor. The pusher block may be pushed against the combustion liner by any suitable pushing means. In one embodiment, the pusher block may be pushed against the combustion liner with a partially threaded rod. Specifically, rotation of the threaded rod may apply an axial force against the combustion liner through a pusher block, thereby pushing the combustion liner into place within the combustor.

From description herein, it should be appreciated that the installation tool of the present subject matter is simple to use and permits a combustion liner to be fully installed within a combustor within a relatively short period of time. Moreover, due to its simple design, the installation tool may be relatively inexpensive to manufacture. Further, depending on the materials chosen, the installation tool may be lightweight. As such, the tool can be carried, positioned on the combustor and otherwise used to install a combustion liner by a single maintenance worker. Thus, the installation tool of the present subject matter may replace complex and dangerous power tools and/or heavy installation tools that otherwise require a crane or similar lifting equipment to position the tool with respect to the combustion liner.

Figure 2:
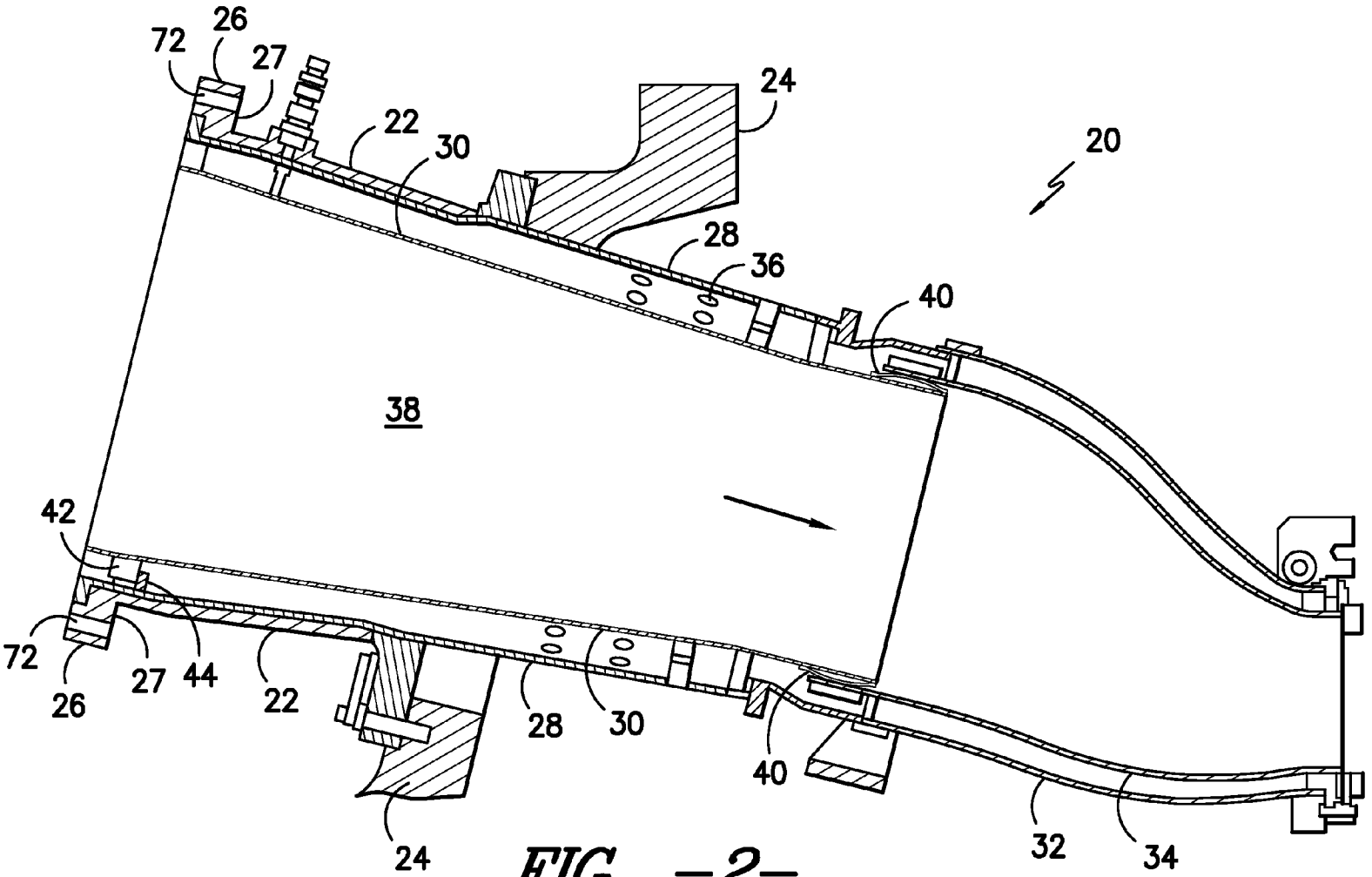
FIG. 2 illustrates a cross-sectional view of an embodiment of a combustor of a turbine assembly.

Referring to the drawings, FIG. 1 illustrates a schematic depiction of an embodiment of a turbine assembly 10. The turbine assembly 10 includes a compressor section 12, a combustion section 14, and a turbine section 16. The combustion section 14 may include a plurality of combustors 20 (one of which is illustrated in FIG. 2) disposed around an annular array about the axis of the turbine assembly 10. The compressor section 12 and turbine section 16 may be coupled by a shaft 18. The shaft 18 may be a single shaft or a plurality of shaft segments coupled together to form the shaft 18. During operation, the compressor section 12 supplies compressed air to the combustion section 14. The compressed air is mixed with fuel and burned within each combustor 20 (FIG. 2) and hot gases of combustion flow from the combustion section 14 to the turbine section 16, wherein energy is extracted from the hot gases to produce work.

Referring to FIG. 2, a cross-sectional side view of an embodiment of a combustor 20 of a turbine assembly 10 is illustrated. The combustor 20 may generally include a substantially cylindrical combustion casing 22 secured to a portion of a gas turbine casing 24, such as a compressor discharge casing or a combustion wrapper casing. As shown, a flange 26 may extend outwardly from an upstream end of the combustion casing 22. The flange 26 may generally be configured such that an end cover assembly (not illustrated) may be secured to the combustion casing 22. For example, the flange 26 may define a plurality of flange holes 72 for attaching the end cover assembly to the combustion casing 22.

The combustor may also include an internal flow sleeve 28 and a combustion liner 30 substantially concentrically arranged within the flow sleeve 28. Both the flow sleeve 28 and the combustion liner 30 may extend, at their downstream ends, to a double walled transition duct, including an impingement sleeve 32 and a transition piece 34 disposed within the impingement sleeve 32. It should be appreciated that the impingement sleeve 32 and the flow sleeve 28 may be provided with a plurality of air supply holes 36 over a portion of their surfaces, thereby permitting pressurized air from the compressor section 12 to enter the radial space between the combustion liner 30 and the flow sleeve 28.

The combustion liner 30 of the combustor 20 may generally define a substantially cylindrical combustion chamber 38, wherein fuel and air are injected and combusted to produce hot gases of combustion. Additionally, the combustion liner 30 may be coupled at its downstream end to the transition piece 34 such that the combustion liner 30 and the transition piece 34 generally define a flowpath for the hot gases of combustion flowing from each combustor 20 to the turbine section 16 of the turbine assembly 10.

In one embodiment, shown in FIG. 2, the transition piece 34 may be coupled to the downstream end of the combustion liner 30 with a compression or hula seal 40. In particular, the hula seal 40 may be disposed at the overlapping ends of the transition piece 34 and combustion liner 30 to seal the interface between the two components. Generally, a hula seal 40 comprises a circumferential metal seal configured to be spring/compression loaded between inner and outer diameters of mating parts. It should be appreciated, however, that the interface between the combustion liner 30 and the transition piece 34 need not be sealed with a hula seal 40, but may generally be sealed by any suitable seal known in the art.

The combustion liner 30 may also include one or more male liner stops 42 that engage one or more female liner stops 44 secured to the flow sleeve 28 or, in combustors 20 without a flow sleeve 28, the combustion casing 22. In particular, the male liner stops 42 may be adapted to slide into the female liner stops 44 as the combustion liner 30 is installed within the combustor 20 to indicate the proper installation depth of the combustion liner 30 as well as to prevent rotation of the liner 30 during operation of the turbine assembly 10. Additionally, the liner stops 42,44 may ensure proper circumferential alignment of the liner 30 within the combustor 20. In one embodiment, the female liner stops 44 may be substantially "U-shaped" and the male liner stops 42 may be substantially rectangular in cross-section such that the male liner stops 42 slide into and engage the female liner stops 44. However, it should be appreciated that the liner stops 42,44 may generally have any shape and/or configuration to assist in installation of the combustion liner 30 and/or prevent rotation of the liner 30 during operation. Moreover, it should be appreciated that, in alternative embodiments, the male liner stops 42 may be disposed on the flow sleeve 28 or combustion casing while the female liner stops 44 are disposed on the combustion liner 30.

Figure 3:
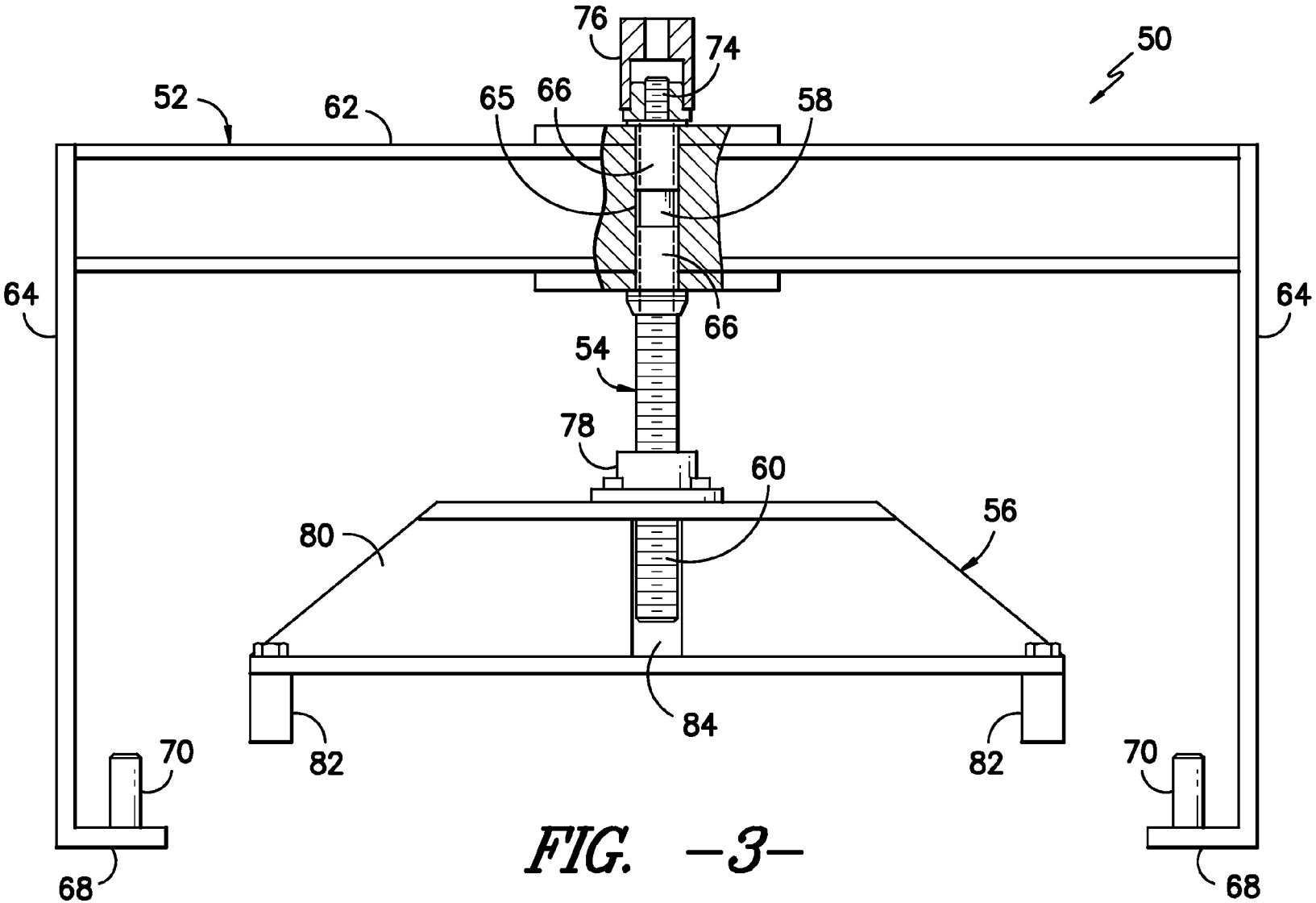
FIG. 3 illustrates a front partial cut away view of an embodiment of an installation tool for installing a combustion liner within a combustor in accordance with an aspect of the present subject matter.

Generally, when installing a combustion liner 30 within a combustor 20, the liner 30 may initially be pushed into the combustor 20 by hand. However, as the combustion liner 30 is pushed into the combustor 20, a point may be reached where hand force limits further installation depth into the transition piece 34. For example, in embodiments utilizing a hula seal 40 to seal the interface between the combustion liner 30 and the transition piece 34, a significant amount of axial force may be required to compress the hula seal 40 and thereby properly position the combustion liner with respect to the transition piece 34. Such axial force, as will be described below, may be provided by the installation tool 50 of the present subject matter to ensure that the combustion liner 30 is fully installed within the combustor 20.

in accordance with an aspect of the present subject matter, FIGS. 3 and 4 illustrate an embodiment of an installation tool 50 for installing a combustion liner 30 within a combustor 20. Generally, the installation tool 50 may include a frame 52, a pusher block 56 and a means for pushing the pusher block 56 against the combustion liner 30. The pushing means may generally connect the pusher block 56 to the frame 52. In one embodiment, an elongated, partially threaded rod 54 may be used to push the pusher block 56 against the combustion liner. For example, the threaded rod 54 may be connected between the pusher block 56 and the frame 52 such that, as the threaded rod 54 is rotated, an axial force is applied to the combustion liner 30 through the pusher block 56.

Generally, the frame 52 of the present subject matter may have any shape and/or configuration that permits the frame 52 to be connected, attached or otherwise secured to a component of the combustor 20 or any other fixed object. In one embodiment, the frame 52 may be substantially "U-shaped" and include a substantially horizontal member 62 and a plurality of side members 64 extending downwardly from the horizontal member 62. The horizontal member 62 may generally have any suitable shape. For example, the horizontal member 62 may comprise an elongated member having a uniform cross-section, such as a rectangular or circular cross-section. In an alternative embodiment, particularly shown in FIG. 4, the horizontal member 62 may be configured as an "I-beam." As such, the horizontal member 62 may have a reduced weight without compromising the strength of the frame 52. Additionally, the side members 64 may generally have any suitable shape or cross-section, such as a rectangular cross-section. Further, as shown in FIG. 3, the side members 62 may be disposed substantially perpendicular to the horizontal member 62. However, in an alternative embodiments, the side members 64 may generally be oriented at any suitable angle relative to the horizontal member 62. Additionally, it should be appreciated that the horizontal and side members 62,64 may be connected or attached to one another by any suitable means. For example, in one embodiment, the side members 64 may be welded or bolted to the horizontal member 62. In an alternative embodiment, the side members 64 may be formed integral with the horizontal member 62, such as by casting.

The frame 52 may also include means for removably attaching, connecting or otherwise securing the frame 52 to a component of the combustor 20 or generally to any other fixed object. In a particular embodiment, the frame 52 may include means for attaching the side members 64 to the combustion casing 22 of the combustor 20. It should be appreciated that the attachment means may generally include any suitable structure, mechanism or device for attaching or connecting the side members 64 to the combustion casing 22. For example, as shown in FIGS. 3 and 4, the attachment means may include a projection 68 extending inwardly from the side members 64. Each projection 68 may be configured to engage an aft side 27 (FIG. 2) of the outwardly extending flange 26 of the combustion casing 22. Thus, in the illustrated embodiment, the length of the horizontal member 62 of the frame 52 may be slightly larger than the diameter of the flange 26 such that the projections 68 of the side members 64 may be positioned around and engage the aft side 27 of the flange 26. Additionally, each projection 68 may include a pin 70, such as a dowel pin, extending upwards from the projection 68. Such pins 70 may be configured to be received in holes defined on opposing ends of the flange 26, such as the pre-existing flange holes 72 (FIG. 2), to attach or otherwise secure the frame 52 to the flange 26 during use of the installation tool.

It should be readily appreciated, however, that the attachment means need not be limited to the projections 68 and pins 70 illustrated in FIGS. 3 and 4. For example, the attachment means may include hooks, clamping mechanisms or any other similar structure for attaching the side members 64 to the combustion casing 22. Alternatively, the attachment means may include a bolt, screw, retaining pin, or a similar attachment mechanism and device. Further, the attachment means may include adhesives, such as glue or tape, or generally any other suitable attachment means known in the art.

The pusher block 56 of the installation tool 50 may generally be disposed between the side members 64 of the frame 52, such as by being disposed directly between the side members 64, as shown in FIG. 3, or by being disposed between linear extensions of the side members 64. Additionally, the pusher block 56 may be movable relative to the frame 52. For example, the pusher block 56 may generally be movable in a direction substantially perpendicular to the horizontal member 62 of the frame 52.

Additionally, the pusher block 56 may generally have any size, shape and/or configuration that permits the pushing member 56 to contact and push against the combustion liner 30 in order to facilitate installation of the liner 30 within the combustor 20. For example, the pusher block 56 may simply comprise a block, plate, disc or similar component configured to push against the combustion liner 20. Alternatively, as shown in FIGS. 3 and 4, the pushing member 56 may comprise a cross member 80 and a plurality of contact pads 82 extending from opposing ends of the cross member 80.

As shown in the illustrated embodiment, the cross member 80 of the pusher block 56 may be configured as an "I-beam." However, it should be appreciated that the cross member 80 may generally have any suitable shape and/or cross-section. Additionally, the contact pads 82 of the pusher block 56 may generally be secured to the cross member 80 by any suitable means, such as by bolts. Further, the contact pads 82 may be configured to contact the combustion liner 30 as the pusher block 56 pushes the liner 30 within the combustion. Thus, the contact pads 82 may serve as the interface between the installation tool 50 and the combustion liner 30 during installation. As such, it should be appreciated that, in one embodiment, the contacts pads 82 may be formed from a relatively soft material to prevent damage to the combustion liner 30. For example, the contact pads 82 may be formed from a soft thermoplastic, such as DERLIN, or any other suitable soft material, such as wood.

The frame 52 and pusher block 56 of the present subject matter may generally be connected to one another by a means for pushing the pusher block 56 against the combustion liner 30. It should be appreciated that, although the pushing means is generally described and depicted herein as including a threaded rod 54, the pushing means may generally include any suitable mechanism, device, or structure for gaining a mechanical advantage when pushing the pusher block 56 against the combustion liner 30 such that a sufficient force may be applied through the pusher block 56 to overcome any installation friction otherwise preventing installation of the combustion liner 30. For example, in addition to a threaded rod or screw, the pushing means may include a pneumatic, hydraulic or similarly actuated cylinder connected between the frame 52 and the pusher block 56. Alternatively, the pushing means may include a jack, such as a screw thread or hydraulic scissor jack, coupled between the frame 52 and pusher block 56. Further, additional pushing means will be apparent to those of ordinary skill in the art.

It should be appreciated that, in using the threaded rod 54 as the pushing means of the present subject matter, the threaded rod 54, in one embodiment, may comprise a fully threaded rod, such as an elongated piece of metal thread stock. Alternatively, the threaded rod 54 may comprise a partially threaded rod. For example, as shown in the illustrated embodiment, the threaded rod 54 may include a first portion 58 and a second portion 60. The first portion 58 of the threaded rod 54 may comprise an unthreaded length of rod while the second portion 60 may comprise a threaded length of rod.

As shown in FIG. 3, the unthreaded first portion 58 of the threaded rod 54 may be rotatably engaged with the horizontal member 62 of the frame 52 such that the threaded rod 54 may be rotated relative to the frame 52. For example, an opening 65 may be defined in the horizontal member 62 for receiving the unthreaded first portion 58 of the threaded rod 54. Additionally, in one embodiment, one or more bearings 66, such as sleeve bearings, ball bearings or the like, may be inserted or otherwise disposed within the opening 65. As such, the unthreaded first portion 58 may then be pressed into the bearings 66 in order to provide rotational engagement of the threaded rod 54 with the frame 52. However, it should be appreciated by those of ordinary skill in the art that various other suitable mechanisms may be utilized to rotatably engage the threaded rod 54 with the frame 52.

Additionally, the threaded second portion 60 of the threaded rod 54 may permit the pusher block 56 to be secured to the rod 54 such that, as the threaded rod 54 is rotated, the pusher block 56 pushes against and applies an axial force to the combustion liner 30. For example, in one embodiment, the pusher block 56 may be in threaded engagement with the second portion 60 of the threaded rod 54. Thus, as shown in FIG. 3, a rotational attachment feature 78, such as a nut, bearing nut or any other suitable threaded female component, may be secured to the pusher block 54. Further, the pusher block 54 may define a through-hole 84 to permit the threaded rod 54 to move within the pusher block 54 as the rod 54 is rotated during installation. As such, when the pusher block 56 is in contact with the combustion liner 30, an axial force may be applied against the liner 30 by rotating the threaded rod 54.

Further, in one embodiment, an end 74 of the threaded rod 54 may extend beyond the top of the horizontal member 62 of the frame 52 to allow a turning mechanism 76 to be attached to the threaded rod 54. Generally, the turning mechanism 76 may be configured to apply torque to or otherwise facilitate rotation of the threaded rod 54. For example, as shown in FIGS. 3 and 4, the turning mechanism 76 may comprise an impact socket attached to the end 74 of the threaded rod 54. As such, a hand ratchet or other suitable device (e.g. a suitable power tool) may be utilized to rotate/turn the threaded rod 54 and thereby apply a force against the combustion liner 30 through the pusher block 56. In alternative embodiments, the turning mechanism 76 may include a crank, a handle or a pulley. Of course, one of ordinary skill in the art should appreciate that various other suitable turning mechanisms may be used to facilitate rotation of the threaded rod 54.

Additionally, it should be appreciated that, in various embodiments of the present subject matter, it may be preferable for the installation tool 50 to be lightweight to permit a single maintenance worker to use the installation tool 50 without necessitating a crane or a similar type of lifting equipment. Thus, in one embodiment, the frame 52, particularly the horizontal and side members 62,64 of the frame 52, and the cross member 80 of the pusher block 56 may be formed from a relatively lightweight material, such as aluminum, an aluminum alloy or a high strength plastic. However, it should be appreciated that such components may formed from various other materials. For example, in alternative embodiments, these components may be formed from steel, a steel alloy or any other suitable material.

It should also be appreciated that the present subject matter is directed to a system for installing a combustion liner 30 within a combustor 20. The system may include a combustor 20 comprising both a combustion casing 22 and combustion liner 30. A frame 52 may be attachable to the combustion casing 22 and may include a substantially horizontal member 62 and a plurality of side members 64. A pusher block 54 may be disposed between the side members and may be configured to apply a force against the combustion liner 30. Additionally, the system may include a means for pushing the pusher block 56 against the combustion liner 30, as generally described above.

The present subject matter is also directed to a method of installing a combustion liner 30 within a combustor 20, which will be described with reference to the embodiment illustrated in FIG. 4. Initially, the combustion liner 30 may be inserted, at least partially, into the combustor 20. For instance, the combustion liner 30 may be loosely set into position to the point where hand force limits further installation depth into the transition piece 34. The installation tool 50 of the present subject matter may then be secured to the combustor 20. Thus, in the illustrated embodiment, the frame 52 may be secured around the flange 26 of the combustion casing 22 such that the projections 68 engage the aft side 27 (FIG. 2) of the flange 26 and the pins 70 are received within the flange holes 72 (FIG. 2) defined on opposing ends of the flange 26. The threaded rod 54 may then be rotated until the pusher block 56 contacts with the combustion liner 30. For example, the threaded rod 54 may be turned by hand while preventing the pusher block 56 from rotating to move the pusher block 56 into contact with the combustion liner 30.

Still referring to the embodiment of FIG. 4, once the pusher block 56 engages or contacts the combustion liner 30, a hand ratchet or other suitable tool may be utilized with the turning mechanism 76 to apply torque to the threaded rod 54. Due to the configuration of the installation tool 50, this rotational torque is translated into an axial force applied through the pusher block 56 against the combustion liner 30. As such, it should be appreciated that, when using a pushing means that provides a mechanical advantage, the pusher block 56 may apply ample force to overcome any friction otherwise preventing installation of the combustion liner 30 (e.g. the friction/force required to compress the hula seal 40). In one embodiment, the pusher block 54 may generally be pushed against the combustion liner 30 until the input toque required on the threaded rod 54 sharply increases, indicating that the male liner stops 42 of the combustion liner 30 have fully engaged the female liner stops 44 disposed on the flow sleeve 28 or combustion casing 22.

Additionally, it should be appreciated that, in one embodiment, the male liner stops 42 of the combustion liner 30 may need to be circumferentially aligned with corresponding female liner stops 44 in order to properly install the combustion liner 30 within the combustor 20. This may be achieved by a maintenance worker visually aligning the male liner stops 42 with the female liner stops 44 as the combustion liner 30 is initially inserted within the combustor 20. Alternatively, the installation tool 50 of the present subject matter may be used in conjunction with an alignment guide configured to guide each male liner stop 42 into its corresponding female liner stop 44.

Referring to FIG. 5, one embodiment of an alignment guide 88 is illustrated that may be secured to the flange 26 of the combustion casing 22 and used to guide a male liner stop 42 into the corresponding female liner stop 44. The alignment guide 88 includes a clamp mechanism 90 and an adjustable screw 92 to secure the guide 88 to the flange 26 of the combustion casing 22. A top plate 94 of the alignment guide 88 may define an opening or window 96 that may be used to position the alignment guide 88 with respect to the female liner stop 44. For example, alignment marks (not illustrated) may be drawn and/or formed on the flange 26 to indicate the locations of the female liner stops 44. A guide plate 98 of the alignment guide 88 may include a channel or track 100 adapted to accommodate at least a portion of the male liner stop 42. For example, the male liner stop 42 may slide down the track 100 as the combustion liner 30 is pushed into place within the combustor 20. The bottom of the guide plate 98 may define a cavity 102 configured such that the guide plate 98 slides over the female liner stop 44 as the alignment guide 88 is installed on the flange 26. As such, the alignment guide 88 may ensure that a male liner stop 42 is properly aligned with its corresponding female liner stop 44 as the combustion liner 30 is pushed within the combustor 20 utilizing the installation tool 50 of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An installation tool for installing a combustion liner within a combustor, the installation tool comprising:

a frame including a substantially horizontal member and a plurality of side members;

a pusher block disposed between said plurality of side members;

means for pushing said pusher block against the combustion liner; and at least one contact pad extending from said pusher block said at least one contact pad contacting said combustion liner as said pusher block is pushed against said combustion liner.

2. The installation tool of claim 1, wherein said plurality of side members are disposed substantially perpendicular to said substantially horizontal member.

3. The installation tool of claim 1, wherein said frame includes means for removably attaching said plurality of side members to a combustion casing of the combustor.

4. The installation tool of claim 3, wherein the means for removably attaching said plurality of side members to the combustion casing includes a projection extending inwardly from each of said plurality of side members, said projection including a pin configured to be received within a flange hole defined in a flange of the combustion casing.

5. The installation tool of claim 1, wherein at least a portion of said frame and at least a portion of said pusher block is made from aluminum, an aluminum alloy or a high strength plastic.

6. The installation tool of claim 1, wherein the means for pushing said pusher block against the combustion liner includes an at least partially threaded rod.

7. The installation tool of claim 6, wherein rotation of said at least partially threaded rod pushes said pusher block against the combustion liner.

8. The installation tool of claim 6, wherein said at least partially threaded rod is in threaded engagement with said pusher block.

9. The installation tool of claim 6, wherein said at least partially threaded rod is rotatably engaged with said frame by one or more bearings disposed within said substantially horizontal member.

10. A system for installing a combustion liner within a combustor, the system comprising:

the combustor including a combustion casing and a combustion liner;

a frame attachable to said combustion casing, said frame including a substantially horizontal member and a plurality of side members;

a pusher block disposed between said plurality of side members; and an at least partially threaded rod, said at least partially threaded rod being rotatably engaged with said frame by one or more bearings disposed within said substantially horizontal member, wherein rotation of said at least partially threaded rod pushes said pusher block against the combustion liner.

11. The system of claim 10, wherein said at least partially threaded rod is in threaded engagement with said pusher block.

12. The system of claim 10, wherein said frame includes a projection extending inwardly from each of said plurality of side members, said projection including a pin configured to be received in a flange hole defined in a flange of said combustion casing.

13. The system of claim 10, comprising one or more contact pads extending from said pusher block, said one or more contact pads contacting said combustion liner as said pusher block is pushed against said combustion liner.

14. An installation tool for installing a combustion liner within a combustor, the installation tool comprising:

a frame including a substantially horizontal member and a plurality of side members, said frame including a projection extending inwardly from each of said plurality of side members, said projection including a pin configured to be received within a flange hole defined in a flange of the combustion casing;

a pusher block disposed between said plurality of side members;

means for pushing said pusher block against the combustion liner.

15. The installation tool of claim 14, wherein said plurality of side members are disposed substantially perpendicular to said substantially horizontal member.

16. The installation tool of claim 14, further comprising at least one contact pad extending from said pusher block, said at least one contact pad contacting said combustion liner as said pusher block is pushed against said combustion liner.

17. The installation tool of claim 14, wherein the means for pushing said pusher block against the combustion liner includes an at least partially threaded rod.

18. The installation tool of claim 17, wherein rotation of said at least partially threaded rod pushes said pusher block against the combustion liner.

19. The installation tool of claim 17, wherein said at least partially threaded rod is in threaded engagement with said pusher block.

20. The installation tool of claim 17, wherein said at least partially threaded rod is rotatably engaged with said frame by one or more bearings disposed within said substantially horizontal member.

* * * * *

UNITED STATES PATENT AND TRADEMARK OFFICE

CERTIFICATE OF CORRECTION

PATENT NO. : 8,713,776 B2
APPLICATION NO. : 12/755787
DATED : May 6, 2014
INVENTOR(S) : Herbold It is certified that error appears in the above-identified patent and that said Letters Patent is hereby corrected as shown below:

In the Specification

Column 4, Line 39, delete "in accordance" and insert -- In accordance --, therefor.

Column 5, Lines 2-3, delete "side members 62" and insert -- side members 64 --, therefor.

Column 5, Line 64, delete "combustion liner 20." and insert -- combustion liner 30. --, therefor.

Column 7, Lines 5-6, delete "pusher block 54. Further, the pusher block 54" and insert -- pusher block 56. Further, the pusher block 56 --, therefor.

Column 7, Line 7, delete "pusher block 54" and insert -- pusher block 56 --, therefor.

Column 7, Line 47, delete "pusher block 54" and insert -- pusher block 56 --, therefor.

Column 8, Line 17, delete "pusher block 54" and insert -- pusher block 56 --, therefor.

In the Claims

Column 9, Line 14, in Claim 1, delete "block" and insert -- block, --, therefor.

Signed and Sealed this
Sixteenth Day of December, 2014

Michelle K. Lee

Michelle K. Lee
*Deputy Director of the United States Patent and Trademark Office*